US011551919B2

(12) United States Patent
Baba et al.

(10) Patent No.: US 11,551,919 B2
(45) Date of Patent: Jan. 10, 2023

(54) RF-ION GUIDE WITH IMPROVED TRANSMISSION OF ELECTRONS

(71) Applicant: DH TECHNOLOGIES DEVELOPMENT PTE. LTD., Singapore (SG)

(72) Inventors: Takashi Baba, Richmond Hill (CA); Pavel Ryumin, Toronto (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 17/284,321

(22) PCT Filed: Oct. 8, 2019

(86) PCT No.: PCT/IB2019/058559

§ 371 (c)(1),
(2) Date: Apr. 9, 2021

(87) PCT Pub. No.: WO2020/075069

PCT Pub. Date: Apr. 16, 2020

(65) Prior Publication Data

US 2021/0384022 A1 Dec. 9, 2021

Related U.S. Application Data

(60) Provisional application No. 62/743,282, filed on Oct. 9, 2018.

(51) Int. Cl.
*H01J 49/00* (2006.01)
*H01J 49/06* (2006.01)

(52) U.S. Cl.
CPC ..... *H01J 49/0054* (2013.01); *H01J 49/063* (2013.01)

(58) Field of Classification Search
CPC ..... H01J 49/0054; H01J 49/063
(Continued)

(56) References Cited

U.S. PATENT DOCUMENTS

2007/0138386 A1 6/2007 Makarov
2016/0126076 A1 5/2016 Baba
2018/0005810 A1* 1/2018 Baba ..... H01J 49/0054

FOREIGN PATENT DOCUMENTS

WO WO 2016/108142 * 7/2016 ..... H01J 49/40

OTHER PUBLICATIONS

International Search Report and Written Opinion for PCT/IB2019/058559 dated Dec. 12, 2019.

* cited by examiner

*Primary Examiner* — Nicole M Ippolito

(57) ABSTRACT

An electron-ion interaction module for use in a mass spectrometer, having a plurality of rod sets arranged relative to one another such that said rod sets share a common longitudinal axis and each of said rod sets is longitudinally separated from an adjacent rod set by a gap, each of said rod sets comprising a plurality of rods arranged around said common longitudinal axis. The module further includes at least one magnet disposed around said rod sets so as to at least partially surround one or more of said plurality of rod sets and configured to generate a static magnetic field along said longitudinal axis. The rod sets are configured to receive electrons from an electron source and ions from an ion source within an interaction volume defined by the rods. One or more RF voltage sources coupled to the plurality of rod sets applies voltages to the rods.

19 Claims, 21 Drawing Sheets

(58) Field of Classification Search
USPC ..... 250/281, 282, 283
See application file for complete search history.

RF-ION GUIDE WITH IMPROVED TRANSMISSION OF ELECTRONS

RELATED APPLICATIONS

This application claims the benefit of priority from U.S. Provisional Application No. 62/743,282, filed Oct. 9, 2018, the entire contents of which is incorporated by reference herein.

FIELD OF THE INVENTION

The present invention relates to devices used in electron-ion reactions.

BACKGROUND

The present invention relates generally to electron-ion interaction modules, such as electron capture dissociation modules, that can be employed in a variety of different mass spectrometers.

Mass spectrometry (MS) is an analytical technique for measuring mass-to-charge ratios of molecules, with both qualitative and quantitative applications. MS can be useful for identifying unknown compounds, determining the structure of a particular compound by observing its fragmentation, and quantifying the amount of a particular compound in a sample.

Mass spectrometers detect chemical entities as ions such that a conversion of the analytes to charged ions must occur during sample processing.

In tandem mass spectrometry (MS/MS), ions generated from an ion source can be mass selected in a first stage of mass spectrometry (precursor ions), and the precursor ions can be fragmented in a second stage to generate product ions. The product ions can then be detected and analyzed.

One common technique for fragmenting ions in MS/MS mass spectrometry is electron capture dissociation (ECD). In ECD, the addition of an electron to a positively charged ion, such as a multiply charged positive ion, can induce fragmentation of the ion. To achieve efficient electron-ion interaction in ECD, it is desirable to have an ion trap with a large capacity and interaction volume. A linear ion trap (LIT) can provide a large ion storage capacity. However, efficient confinement of electrons and ions in an LIT can be difficult because the required RF voltages for ion trapping can cause rapid ejection of the electrons from LIT. The application of a magnetic field along the LIT axis can improve the confinement of electrons within the LIT. However, electron confinement within such a device is still inefficient and hence can be used for fabricating only small-sized devices. By way of example, FIG. 1 shows simulation of electron paths within such an LIT 10 at one end of which a source 12 for generating electrons is disposed. The simulation of the electron paths show that the electrons remain confined only within a small region near the electron source. In other words, only a small fraction of the LIT volume is usable for electron-ion interaction.

Accordingly, there is a need for improved methods and systems for electron-ion interaction for use in a mass spectrometer.

SUMMARY

In one aspect, an electron-ion interaction module for use in a mass spectrometer is disclosed, which comprises a plurality of rod sets arranged relative to one another such that said rod sets share a common longitudinal axis and each of said rod sets is longitudinally separated from an adjacent rod set by a gap, each of said rod sets comprising a plurality of rods arranged around said common longitudinal axis. The module further includes at least one magnet disposed around said rod sets so as to at least partially surround one or more of said plurality of rod sets and configured to generate a static magnetic field along said longitudinal axis. The rod sets are configured to receive electrons from an electron source and ions from an ion source within an interaction volume defined by the rods thereof. One or more RF voltage sources operatively coupled to said plurality of rod sets can apply voltages to the rods of said rod sets such that an RF voltage applied to a rod of any of said rod sets has an opposite phase relative to an RF voltage applied to a respective rod of an adjacent rod set.

In some embodiments, each of the rod sets comprises any of a quadrupole, a hexapole and an octupole rod set. In some embodiments, the plurality of rod sets comprises at least three rod sets positioned in tandem relative to one another about said longitudinal axis. In some embodiments, the rod sets are configured to receive the ions and the electrons along said common longitudinal axis thereof.

In some embodiments, the RF voltages applied to the rod sets are configured to cause radial trapping of any of the electrons and ions within the interaction volume defined by the rod sets. By way of example, the RF voltages can have a frequency in a range of about 200 kHz to about 10 MHz and an amplitude in a range of about 100 V to about 10 kV.

In some embodiments, the magnetic field generated by said magnet has a magnitude in a range of about 0.1 Tesla to about 21 Tesla.

In some embodiments, the gaps separating adjacent rod sets can be in a range of about 0.1 mm to about 10 mm. In some embodiments, the ratio of a gap between two adjacent rods relative to a gap radially separating two rods of a rod set can be, for example, any of 0.1, 0.5, 1 and 2.

In some embodiments, the electron-ion interaction module can include a plurality of ion-trapping rods disposed between two or more rods of at least one of said rod sets, and a DC voltage source for applying one or more DC voltages to said ion-trapping rods for trapping at least a portion of said ions within a volume of said at least one of said rod sets.

In some embodiments, the electron-ion interaction module can further include an electrode disposed in proximity of an exit port of said plurality of rod sets and configured for providing axial trapping of the ions upon application of a suitable voltage thereto. For example, a DC voltage in a range of about 5 to about 100 volts can be applied to such an electrode to inhibit the drift of the ions out of the interaction volume defined by the rods of the rod sets.

In some embodiments, the electron-ion interaction module can further include a controller in communication with said at least one RF voltage source for controlling application of RF voltages to the rods of said rod sets.

In some embodiments, the electron-ion interaction module can comprise an electron capture module, an electron impact dissociation (EID) module, an electron impact excitation of ions from organics (EIEO) module, and an electron detachment dissociation (EDD) module.

In a related aspect, a mass spectrometer is disclosed, which comprises a linear ion trap (LIT) comprising at least three rod sets arranged relative to one another such that said rod sets share a common longitudinal axis and each of said rod sets is longitudinally separated from an adjacent rod set by a gap, each of said rod sets comprising a plurality of rods arranged around said common longitudinal axis, where the linear ion trap comprises an inlet for receiving ions. The mass spectrometer further includes an electron source for generating electrons and an ion source for generating ions and introducing the electrons and the ions into said linear ion trap. At least one magnet is disposed around the rod sets so as to at least partially surround one or more of said plurality of rod sets and configured to generate a magnetic field along said longitudinal axis. The mass spectrometer further includes one or more RF voltage sources that are operatively coupled to said plurality of rod sets for applying voltages to the rods of said rod sets such that an RF voltage applied to a rod of any of said rod sets has an opposite phase relative to an RF voltage applied to a respective rod of an adjacent rod set, wherein said applied RF voltages are configured to generate an RF electromagnetic field for radially confining said ions within said linear ion trap.

In some embodiments of the above mass spectrometer, each of the rod sets comprises any of a quadrupole, a hexapole and octupole rod set.

In some embodiments, the longitudinal magnetic field has a strength in a range of about 0.1 Tesla to about 21 Tesla. Further, in some embodiments, the RF voltage sources are configured to generate RF voltages at a frequency in a range of about 200 kHz to about 10 MHZ.

Further, in some embodiments, the RF voltages have an amplitude in a range of about 100 V to about 10 kV.

In some embodiments of the above mass spectrometer, a gap separating two adjacent rod sets from one another can be, for example, in a range of about 0.1 mm to about 10 mm. In some embodiments, the ratio of a gap between two adjacent rods relative to the gap separating two rods of a rod set can be, for example, any of 0.1, 0.5, 1 and 2.

In a related aspect, a method of performing electron-ion interaction is disclosed, which comprises introducing ions and electrons into a plurality of rod sets arranged relative to one another such that said rod sets share a common longitudinal axis and each of said rod sets is longitudinally separated from an adjacent rod set by a gap, each of said rod sets comprising a plurality of rods arranged about said common longitudinal axis. A static magnetic field is applied along said common longitudinal axis and RF voltages are applied to the plurality of rod sets so as to confine at least a portion of the ions and the electrons within a volume surrounded by the rods of the plurality of rod sets, where an RF voltage applied to a rod of any of the rod sets has an opposite phase relative to an RF voltage applied to a respective rod of an adjacent rod set.

In some embodiments, the number of the rod sets can be at least 3, e.g., in a range of 3 to 20.

In some embodiments of the above method, each of the rod sets comprises any of a quadrupole, a hexapole and an octupole rod set. In some embodiments, the applied static magnetic field has a strength in a range of about 0.1 Tesla to about 21 Tesla. Further the applied RF voltages can have a frequency in a range of about 200 kHz to about 10 MHz. Moreover, in some embodiments, the RF voltages can have an amplitude in a range of about 100 V to about 10 kV.

Further understanding of various aspects of the present teachings can be obtained by reference to the following detailed description in conjunction with the associated drawings, which are described briefly below.

DETAILED DESCRIPTION

The present teachings are generally directed to an electron-ion interaction module that can be employed in a mass spectrometer. In some embodiments, an electron-ion interaction module according to the present teachings includes a plurality of quadrupole rod sets that are positioned in tandem about a common longitudinal axis. RF voltages are applied to the rods of the rod sets such that an RF voltage applied to a rod of any of said rod sets has an opposite phase relative to an RF voltage applied to a respective rod of an adjacent rod set. It has been discovered that the application of RF voltages to the rod sets in this manner can help confine electrons in the vicinity of the longitudinal axis of the rods sets, thereby increasing the efficiency of electron-ion interactions throughout the volume of the module. It should be understood that the present teachings are not limited to quadrupole rod sets, but any suitable multi-pole rod sets, such as hexapole and octupole rod sets, can be employed in the practice of the present teachings. For sake of clarity, in some of the embodiments discussed below, the magnet surrounding the rod sets of an electron-ion interaction module is not shown.

The term "about" as used herein denotes a deviation at most 5%, e.g., relative to a numerical value, and the term "substantially" as used herein denotes a variation from a complete state by at most 10%.

Further, as used herein, "a respective rod of an adjacent rod set" refers to a rod that is positioned along a putative longitudinal extension of a rod of a neighboring rod set.

Figure 1:
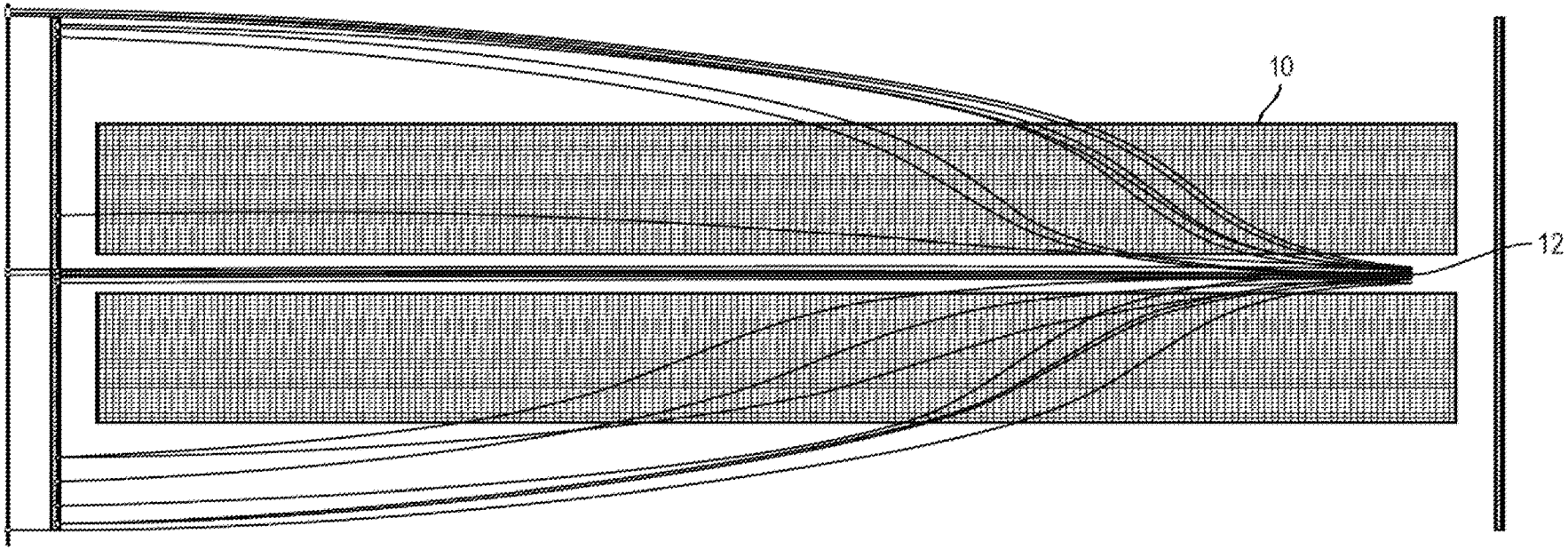
FIG. 1 PRIOR ART
FIG. 1 shows simulated electron paths within a conventional linear ion trap.
Figure 2A:
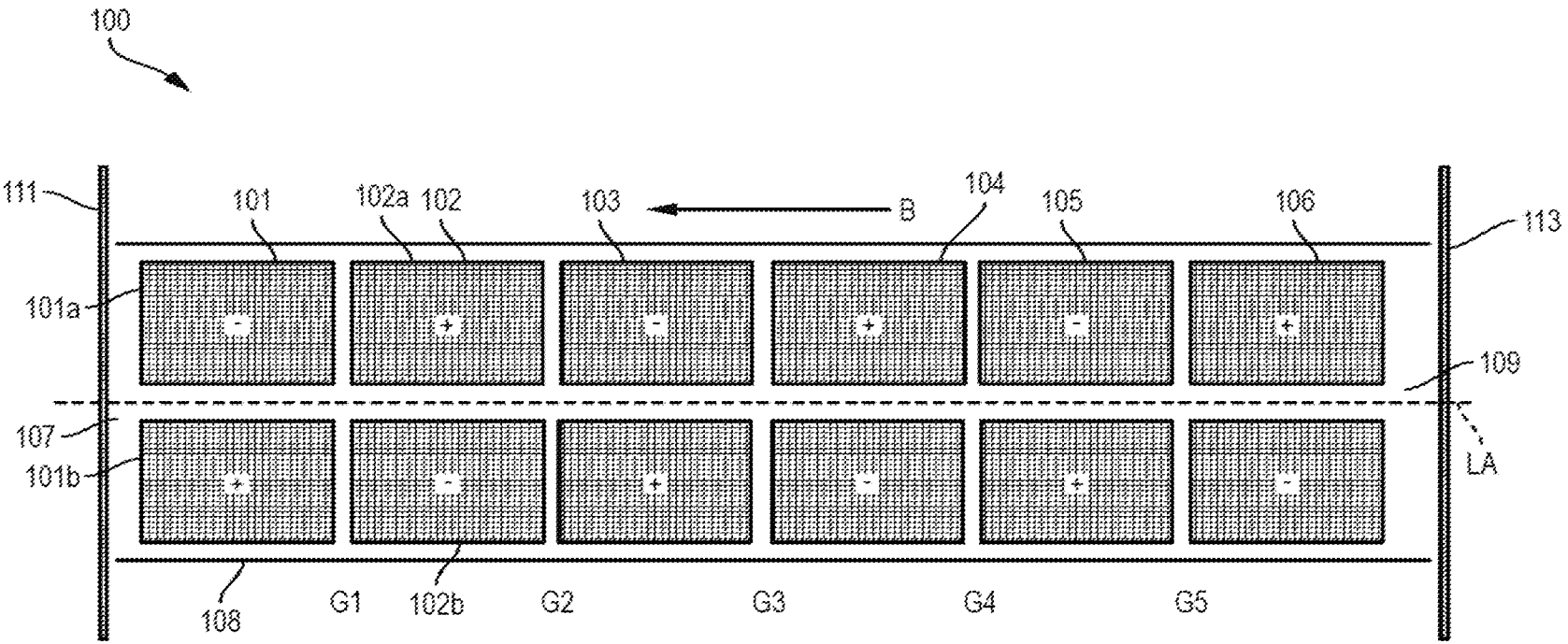
FIG. 2A is schematic view of an electron-ion interaction module according to an embodiment of the present teachings, which includes a plurality of quadrupole rod sets positioned in tandem along a common longitudinal axis.
Figure 2B:
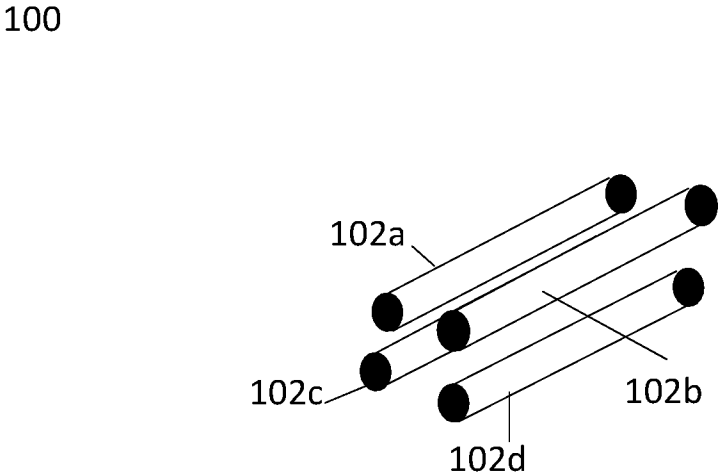
FIG. 2B is a perspective schematic view of one of the quadrupole rod sets depicted in FIG. 2A.
Figure 2C:
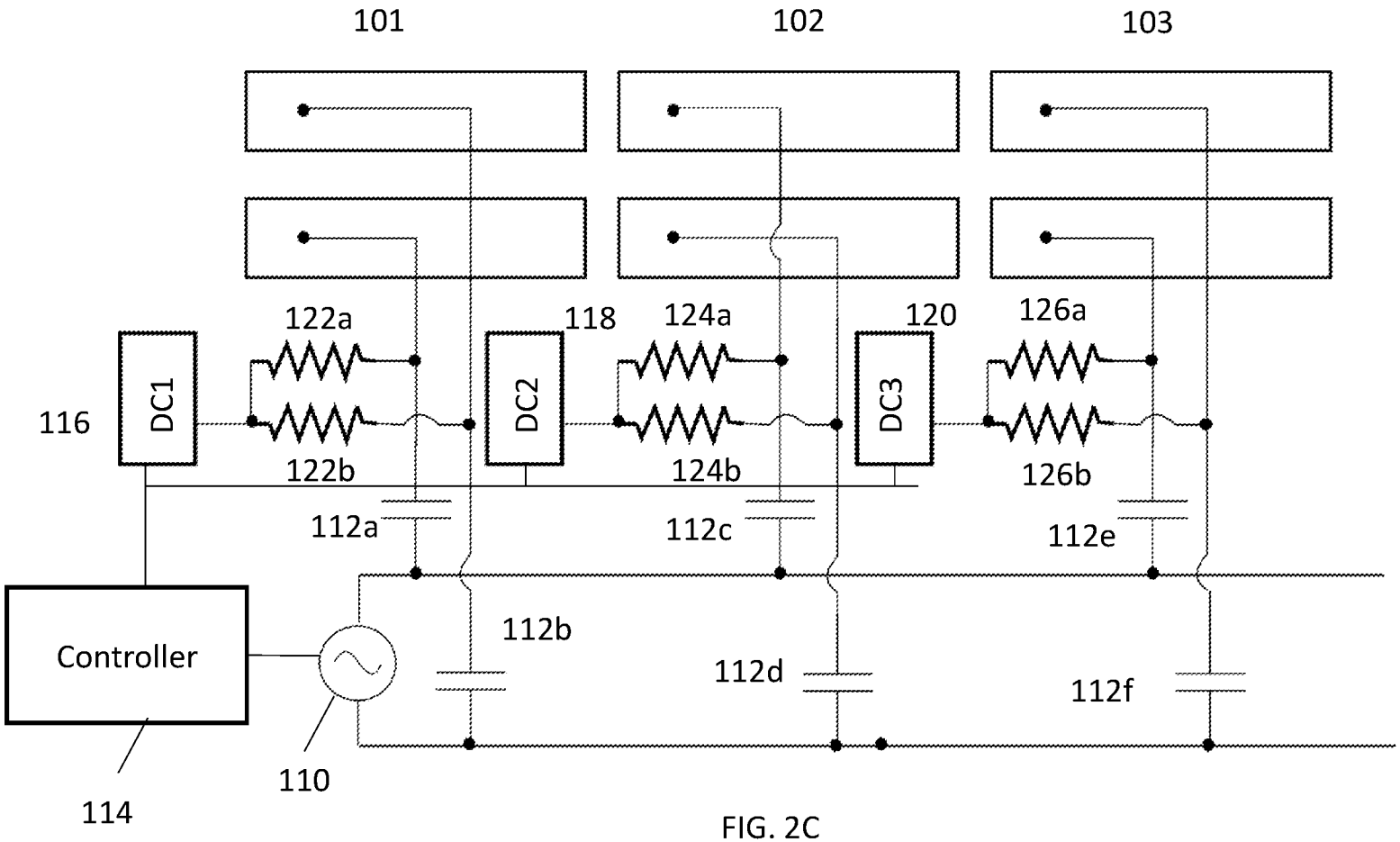
FIG. 2C is a partial schematic view of the electron-ion interaction module of FIG. 2A depicting the application of RF and DC voltages to the rods of the rod sets.

FIGS. 2A, 2B and 2C schematically depict an electron-ion interaction module 100 (herein also referred to as electron-ion reaction module) for use in a mass spectrometry system, which includes six quadrupole rod sets 101, 102, 103, 104, 105 and 106 that are disposed in series relative to one another so that they share a common longitudinal axis (LA). More specifically, each quadrupole rod set includes four rods arranged in a quadrupole configuration. By way of example, FIG. 2B schematically depicts that quadrupole rod set 101 includes four rods 101*a*, 101*b*, 101*c*, and 101*d*, which are arranged around the longitudinal axis (LA) in a quadrupole configuration. The other quadrupole rod sets include a similar arrangement of rods (FIG. 1A shows only two of the rods of each quadrupole rod set). The quadrupole rods sets are arranged in tandem relative to one another such that their longitudinal axes are aligned so as to form the common longitudinal axis (LA).

A plurality of axial gaps G1, G2, G3, G4, and G5 (herein collectively referred to as the axial gaps G) axially separate each quadrupole rod set from a neighboring one. In this embodiment, the axial gaps G are uniform while in other embodiments, the gaps can be non-uniform (i.e., they can have different values). In some embodiments, the gaps G can be, for example, in a range of about 0.1 mm to about 10 mm.

The electron-ion interaction module 100 further includes a magnet 108, e.g., a permanent magnet, that has a cylindrical shape and surrounds the quadrupole rod sets. In this embodiment, the magnet 108 generates a static magnetic field B within a volume enclosed by the rods of the quadrupole rod sets (herein also referred to as the "electron-ion interaction volume"). The magnetic field lines associated with the magnetic field generated by the magnet 108 are substantially parallel to the common longitudinal axis (LA). In this embodiment, the magnetic field (B) generated along the common longitudinal axis of the rod sets has a magnitude, for example, in a range of about 0.1 Tesla to about 21 Tesla.

In this embodiment, the electron-ion interaction module 100 includes an inlet port 107 for receiving electrons and ions from an ion source and electron source (not shown in this figure) and an exit port 109 through which ions and electrons can exit the electron-ion reaction module, as discussed in more detail below. By way of example, the ion source can be positioned upstream of the electron-ion interaction module (See, e.g., ion source 1302 in FIG. 13), and the electron source can be positioned, e.g., at a proximal end of the rod sets (See, e.g., electron source 1306 in FIG. 13). In this embodiment, two electrodes 111 and 113 can be optionally positioned in proximity of the input and the output ports of the rod sets such that application of an appropriate voltage thereto can help axially confine the ions within the interaction module. In this embodiment, the electrodes are also used to maintain different (higher) pressure in the ECD device. In other embodiments, the electrodes may not be employed.

As shown in FIG. 2C, at least one radiofrequency (RF) source 110 is capacitively coupled via capacitors 112*a*, 112*b*, 112*c*, 112*d*, 112*e* and 112*f* to the rods of the quadrupole rod sets to apply RF voltages thereto (for clarity only the quadrupole rod sets 101, 102 and 103 are shown in this figure; the RF source is coupled to the rod sets 104, 105 and 106 via a similar pattern of capacitors). In some embodiments, the RF voltages applied to the rods of the quadrupole rod sets can have a frequency, for example, in a range of about 200 kHz and 10 MHz and an amplitude in a range of about 100 V to about 10 kV.

Further, in this embodiment, a plurality of DC voltage sources 116, 118, 120 are coupled electrically to the rods of the rod sets via resistors 122*a*/122*b*, 124*a*/124*b*, 126*a*/126*b* (for clarity only the connections of the DC voltage sources to the quadrupole rod sets 101, 102, and 103 are shown in this figure; additional voltage sources and resistors are used for applying DC voltages to the rods of the quadrupole rod sets 104, 105 and 106). The DC voltage sources can apply DC voltages to the rods of the quadrupole rod sets, for example, to trap ions within an interaction volume of the rod sets and/or modulate the energy of the electrons within the interaction module. In some embodiments, the DC voltages applied to the rods of the rod sets can be, for example, in a range of about 0 to about 100 volts (in embodiments in which negative ions are interrogated, negative voltages are utilized). Further, DC voltages can be applied to the electrodes 111 and 113 to help trap ions within the electron-ion interaction module.

A controller 114 in communication with the RF source 110 and the DC voltage sources (116, 118 and 120) can control the application of the RF and/or DC voltages to the rods of the quadrupole rod sets (and the electrodes 111 and 113). For example, the controller 114 can control the application of RF voltages to the rods of the quadrupole rod sets such that the phase of a voltage applied to any rod of the rod sets is opposite to the phase of the RF voltage applied to a respective rod of a neighboring rod set.

For example, with reference again to FIG. 1A, at a given moment in time, the voltage applied to rod 101*a* of the quadrupole rod set 101 has a negative polarity whereas the voltage applied to rod 102*a* of the quadrupole rod set 102, which is placed along the axial extension of the rod 101*a* and separated therefrom by the gap (G1), has a negative polarity. Further, while the voltage applied to rod 101*b* of the quadrupole rod set 101 has a positive polarity, the voltage applied to the respective rod 102*b* of the quadrupole rod set 102 has a negative polarity. Similar pattern of opposite polarities can be observed in FIG. 1A for the respective rods of the other quadrupole rod sets.

It has been discovered that configuring the phases of the RF voltages applied to the quadrupole rod sets in this manner together with the application of a static magnetic field to the interaction volume in a manner discussed above can result in an RF electromagnetic field within the interaction volume of the quadrupole rod sets that confines the electrons injected into the electron-ion interaction module in the vicinity of the longitudinal axis as the electrons travel along the length of the quadrupole rod sets. This can in turn allow efficient interaction of the electrons with ions introduced into the electron-ion reaction module. For example, when the module is configured as an electron capture module, the effective confinement of the electrons within the interaction module can allow efficient production of product ions via electron capture dissociation.

Figure 3:
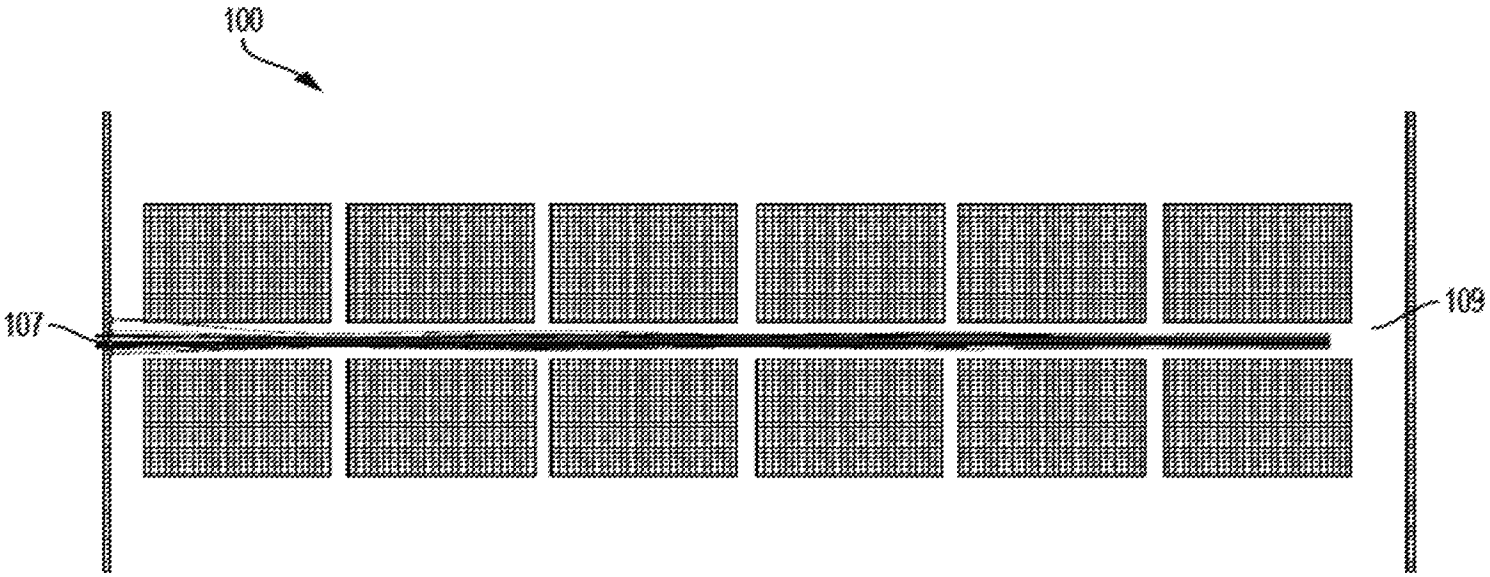
FIG. 3 shows simulated electron paths through an electron-ion interaction module according to an embodiment of the present teachings.

By way of illustration, FIG. 3 shows the results of simulation of electron paths within the interaction volume of an electron-ion reaction module according to the present teachings comprising six quadrupole rod sets positioned in series, such as the electron-ion reaction module 100 discussed above. The electrons were simulated to enter the electron-ion reaction module via an input port 107 at an energy of 3 keV and exit the ion reaction module via an exit port 109. The RF voltages applied to the rods of the quadrupole rod sets had instantaneous polarities such as those discussed above in connection with the electron-ion reaction module 100. In particular, the application of the RF voltages to the rods of the quadrupole rod sets is such that an RF voltage applied to a rod of any of the quadrupole rod sets has an opposite phase relative to an RF voltage applied to a respective rod of an adjacent quadrupole rod set. The RF amplitude was 200 V and the RF frequency was 1 MHz. Moreover, the simulation employed a magnetic field applied along the longitudinal axis of the quadrupole rod sets at a value of 0.17 Tesla.

As the simulation shows, the electrons are substantially confined along the longitudinal axis of the interaction volume as they traverse the electron-ion interaction volume from the input port to the exit port. Such confinement of electrons as they traverse the electron-ion interaction module can advantageously enhance the interaction of the electrons with ions introduced into the electron-ion module.

Figure 4:
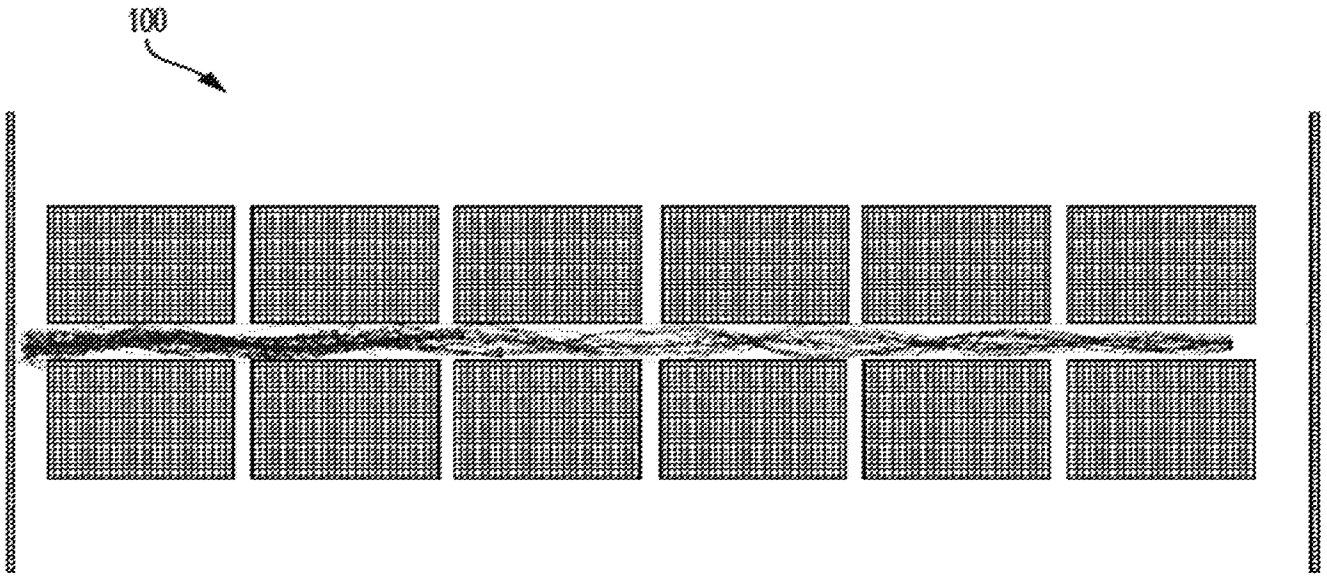
FIG. 4 shows simulated results of ion paths of typical ions (m/z of $1000^{Th}$) trapped in an electron-ion interaction module according to an embodiment of the present teachings.

By way of another example, FIG. 4 depicts the ion paths of typical ions (m/z 1000 Th) trapped in an electron-ion interaction module under the same operational conditions as for simulations of electron paths.

Figure 5B:
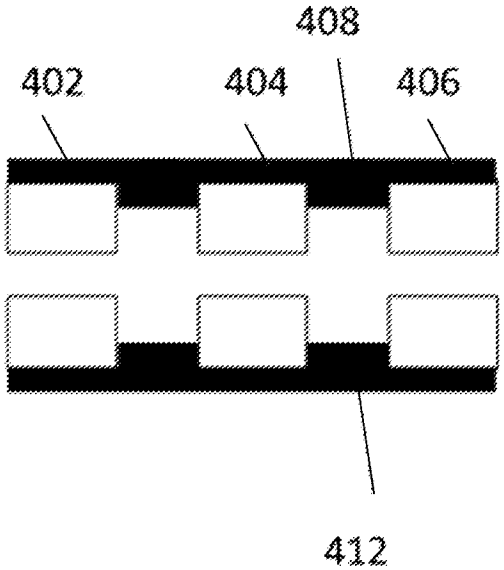
FIG. 5B is a schematic side view of the ion-electron interaction module depicted in FIG. 5A.
Figure 5A:
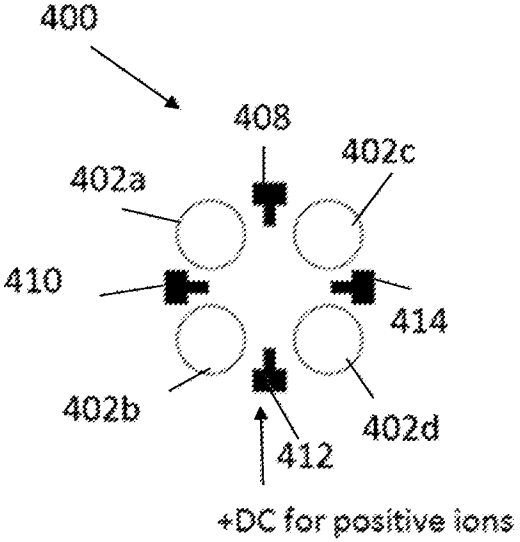
FIG. 5A is a schematic end view of an ion-electron interaction module according to an embodiment, which includes a plurality of bars for radially confining ions within the module.

In some embodiments, the electron-ion interaction module can be configured to trap ions entering the module within the interaction volume thereof. By way of example, FIG. 5A and 5B schematically depict an embodiment of an electron-ion interaction module 400, which similar to the above electron-ion interaction module 100, includes a plurality of quadrupole rod sets (e.g., 3) 402, 404, and 406 that are positioned in series relative to one another. Similar to the previous embodiment, each quadrupole rod set includes four rods arranged in a quadrupole configuration. For example, the quadrupole rod set 402 includes four quadrupole rods 402*a*, 402*b*, 402*c*, and 402*d* that are arranged relative to one another in a quadrupole configuration.

In this embodiment, four ion-trapping rods 408, 410, 412 and 414 having T-shaped portions are disposed along the length of the quadrupole rod sets in the spaces between the rods of the quadrupole rod sets. The application of appropriate positive DC voltages to the bars, e.g., DC voltages in a range of about 2 volts to about 100 volts relative to DC offset (negative voltages are applied for negative ions), allows radial confinement of the positive ions entering the electron-ion interaction module.

Figure 6B:
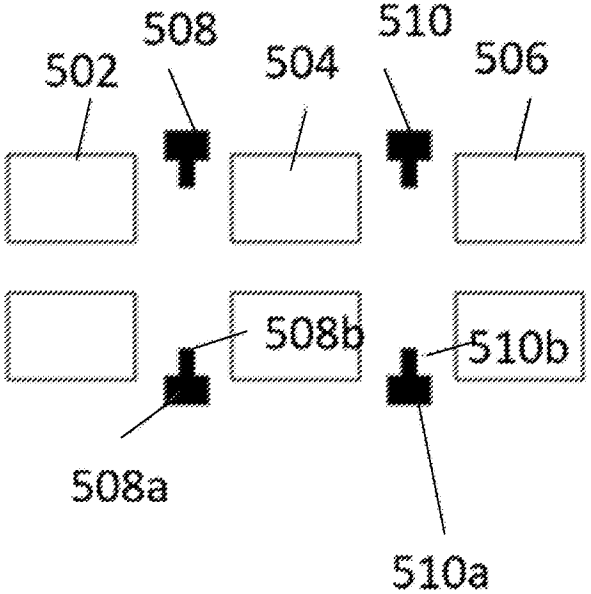
FIG. 6B is a side view of the ion-electron interaction module of FIG. 6A.
Figure 6A:
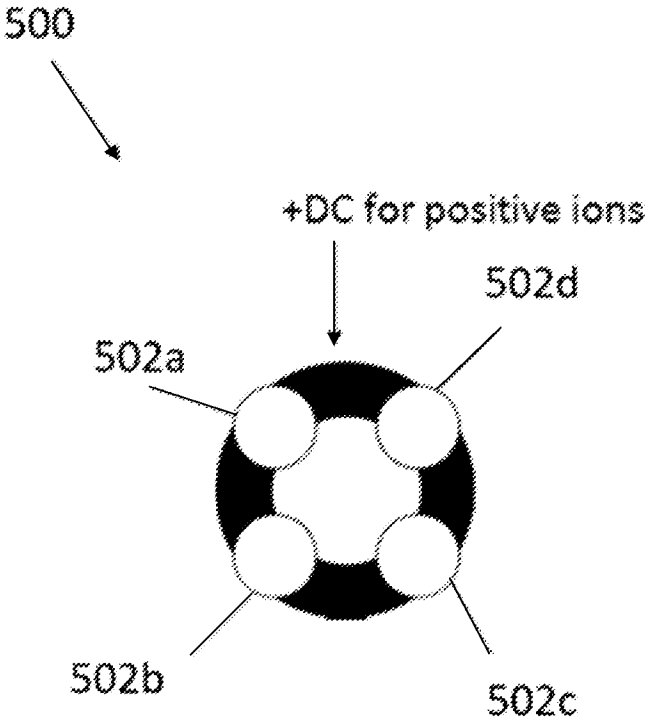
FIG. 6A is a schematic end view of an ion-electron interaction module according to an embodiment, which includes a plurality of bars disposed between quadrupole rod sets of the module for radially confining ions within the module.

By way of another example, FIGS. 6A and 6B schematically depict another embodiment of an electron-ion interaction module 500 according to the present teachings that provides, in addition to electron confinement in the vicinity of the longitudinal axis of the module, radial confinement of positive ions entering the electron-ion interaction module. The electron-ion interaction module 500 includes three quadrupole rod sets 502, 504, and 506, each of which includes four rods arranged in a quadrupole configuration. For example, quadrupole rod set 502 includes rods 502*a*, 502*b*, 502*c*, and 502*d* that are arranged relative to one another in a quadrupole configuration.

In this embodiment, a plurality of circular bars 508, 510 are disposed between adjacent quadrupole rod sets. The circular bars 508, 510 include peripheral circular rims 508*a*/510*a* from which inner circular collars 508*b*/510*b* extend. Similar to the previous embodiment, the application of positive DC voltages, e.g., in a range of about 2 to about 100 volts, to the circular bars 508/510 can repel positive ions within the interaction region of the quadrupole rod sets toward the center of the rod sets, thereby radially confining the ions.

Figure 7:
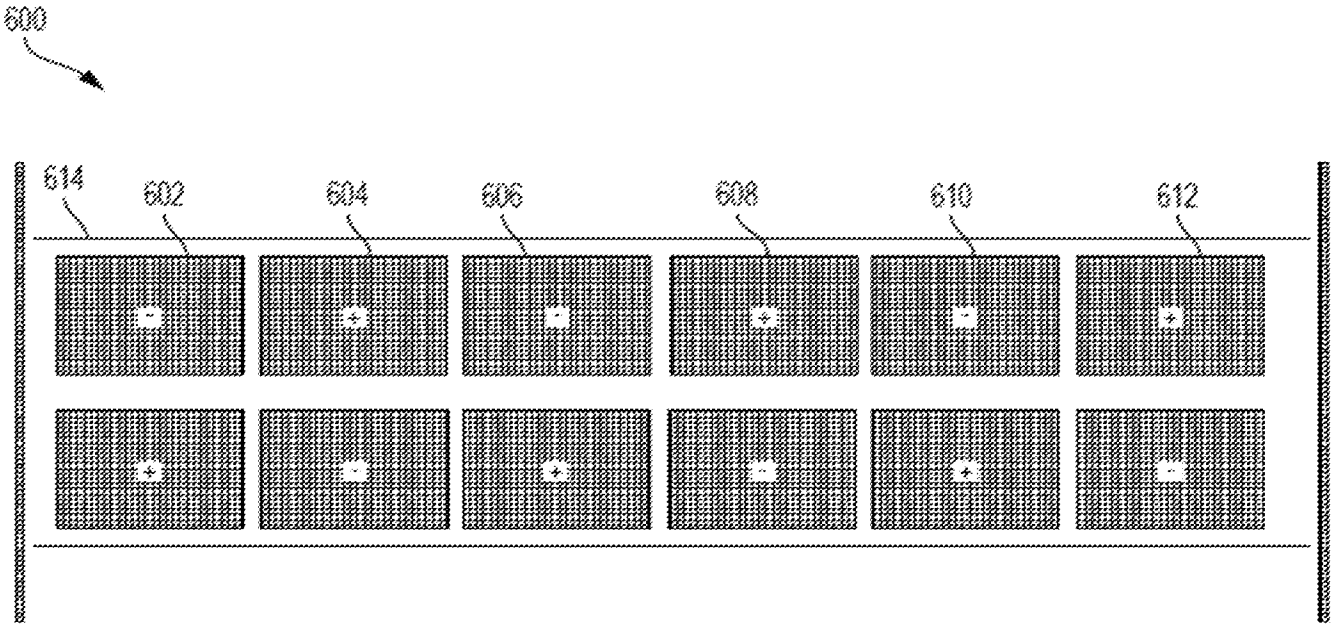
FIG. 7 is a schematic side view of an ion-electron interaction module according to an embodiment in which a conductive cylinder surrounding a plurality of quadrupole rod sets of the module is employed for radially confining ions within the module.

FIG. 7 schematically depicts yet another embodiment 600 of an electron-ion interaction module according to the present teachings, which includes a plurality of quadrupole rod sets 602, 604, 606, 608, 610, and 612 that are positioned in series in a manner discussed above in connection with the previous embodiments, and further includes a conductive cylinder 614 that surrounds the quadrupole rod sets. The application of a positive DC voltage to the conductive cylinder can repel the ions entering the interaction volume back to the center of that volume, thereby radially confining those ions. Though not shown in this figure, similar to the previous embodiments, a magnet, such as a permanent or an electromagnet, can surround the quadrupole rod sets and generate a static magnetic field substantially along the longitudinal axis of the rod sets.

Figure 8:
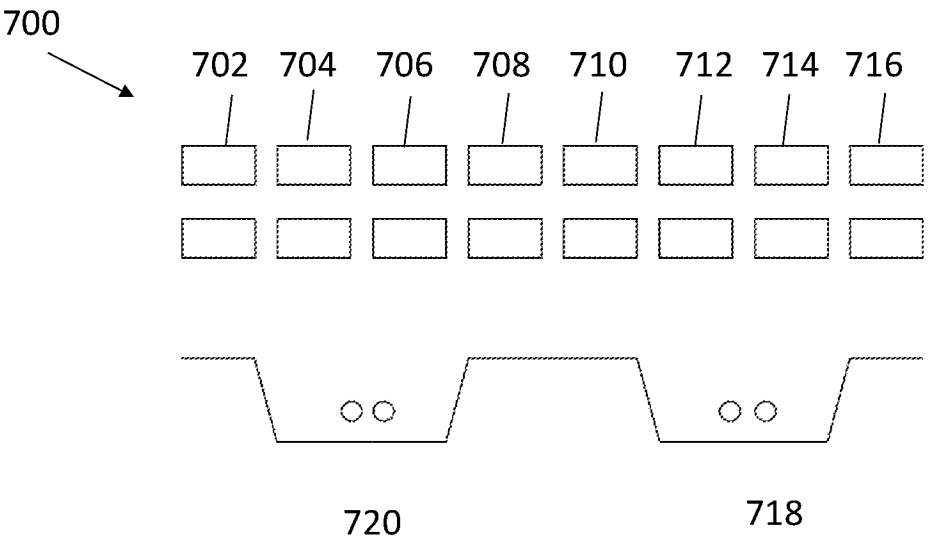
FIG. 8 is a schematic view of an ion-electron interaction module according to an embodiment in which the application of DC voltages to selected quadrupole rod sets generates a plurality of DC potential wells for trapping ions.

In some embodiments, the application of a differential DC voltage between two or more of the quadrupole rod sets of an electron-ion interaction module according to the present teachings can be used to trap ions within an interaction volume defined by those quadrupole rod sets. By way of example, FIG. 8 schematically depicts an electron-ion interaction module 700 according to an embodiment that includes eight quadrupole rod sets 702, 704, 706, 708, 710, 712, 714, and 716 that are positioned in series relative to one another. Similar to the previous embodiments, a controller (not shown in this figure) in communication with an RF source (not shown in this figure) controls the application of the RF voltages to the rods of the quadrupole rod sets such that an RF voltage applied to a rod of any of the quadrupole rod sets has an opposite phase relative to an RF voltage applied to a respective rod of an adjacent quadrupole rod set. Though not shown in the figure, a magnet can surround the quadrupole rod sets for generating a static magnetic field along the longitudinal axis of the quadrupole rod sets in a manner discussed above in connection with the previous embodiments.

The application of different DC voltages to the rods of the different quadrupole rod sets can allow trapping ions within volumes defined by a subset of the quadrupole rod sets and can further modulate the energy of electrons as they enter and propagate through the electron-ion interaction module. The application of DC voltages to the rods of the different quadrupole rod sets can generate DC potential wells in which ions can be trapped. In some embodiments, a DC potential well can span multiple quadrupole rod sets while in the other embodiments a DC potential well can span a single quadrupole rod set.

By way of example, in this embodiment, the application of different DC voltages (e.g., DC voltages in a range of about 0 V to about 100 V), such as those depicted in FIG. 8, to the rods of the different quadrupole rod sets can generate DC potential wells 718 and 720 in which precursor ions can be trapped. In some embodiments, one type of precursor ions can be trapped in one of the potential wells and a different type of precursor ions can be trapped in the other potential well. Further, the electric field generated within the interaction volume defined by the quadrupole rod sets via application of the depicted DC voltages can modulate the energy of the electrons as they propagate through the electron-ion interaction module.

In some embodiments, the DC differential voltages employed for generating DC potential wells can be, for example, in a range of about 0 to about 100 volts. For example, in this embodiment, the energy of the electrons entering the electron-ion interaction module (from the left side) at an energy of 6 eV drops to an energy of 1 eV in the potential well 718 generated in the interaction volume defined by the quadrupole rod sets 712 and 714. The electron energy then increases back to 6 eV as the electrons pass through the interaction volume defined by the quadrupole rod sets 710 and 708. The electron energy drops again to 1 eV within the interaction volume defined by the quadrupole rod sets 706 and 704 and finally climbs up to +5 eV as electrons exit the electron-ion interaction volume via quadrupole rod set 702. In the described embodiment, the energy of electrons is changed because of the need to change potential to efficiently confine ions in axial direction in their respective wells. In general, in embodiment shown in FIG. 10 where interaction volumes are arranged to have different energies, it is done to direct fragmentation through different pathways to obtain different product ions produced with different energies. In some embodiments with different precursors, electron energy could be optimized for each particular precursor. In this embodiment, the precursor ions are sequentially loaded in different wells, which can be a fast process. The product ions can be sequentially unloaded from the wells.

In this embodiment, electron capture reactions can be performed in parallel, which can be advantageous as the rate of the electron capture reactions can be typically slow. As in many embodiments the electron capture efficiency can be low and the electron currents can be relatively high, the ions are exposed to substantially similar electron current independent of the position of their respective well (not accounting for electron transport losses), and hence electron capture reactions can happen in parallel.

Figure 9:
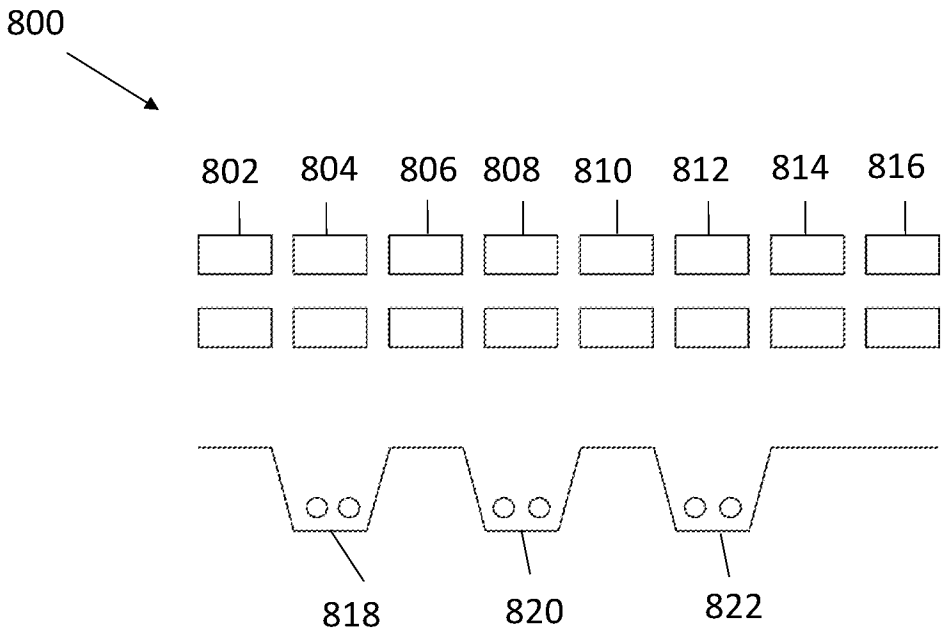
FIG. 9 is a schematic view of an ion-electron interaction module according to an embodiment in which the application of DC voltages to selected quadrupole rod sets generated three DC potential wells for trapping ions.

By way of another example, FIG. 9 shows another embodiment of an electron-ion interaction module 800 according to the present teachings, which includes quadrupole rod sets 802, 804, 806, 808, 810, 812, 814 and 816 that are positioned in series about a common longitudinal axis. The application of DC voltages, for example, in a range of about 0 V to about 10 V, to selected quadrupole rod sets can generate a DC potential differential between one or more of the rod sets to generate DC potential wells for trapping ions. By way of example, in this embodiment, the application of the DC voltages depicted in the figure can result in the generation of three potential wells 818, 820 and 822 for trapping precursor ions within the quadrupole rod sets 804, 808 and 812 and modulating the electron energy as the electrons pass through the electron-ion interaction module. In some embodiments, for low energy electrons, it can be beneficial to maintain the transient time during the refocusing stage (which translates into the requirement of the same energy, and hence no change in potential), which ensures that there is no significant defocusing. This can be achieved, for example, by having an even number of rod sets passed by electrons with the same energy. For higher energy electrons, the refocusing can be less of a concern, thus allowing the use of more ion wells while still maintaining efficient electron confinement, and hence more efficient parallel processing.

Figure 10:
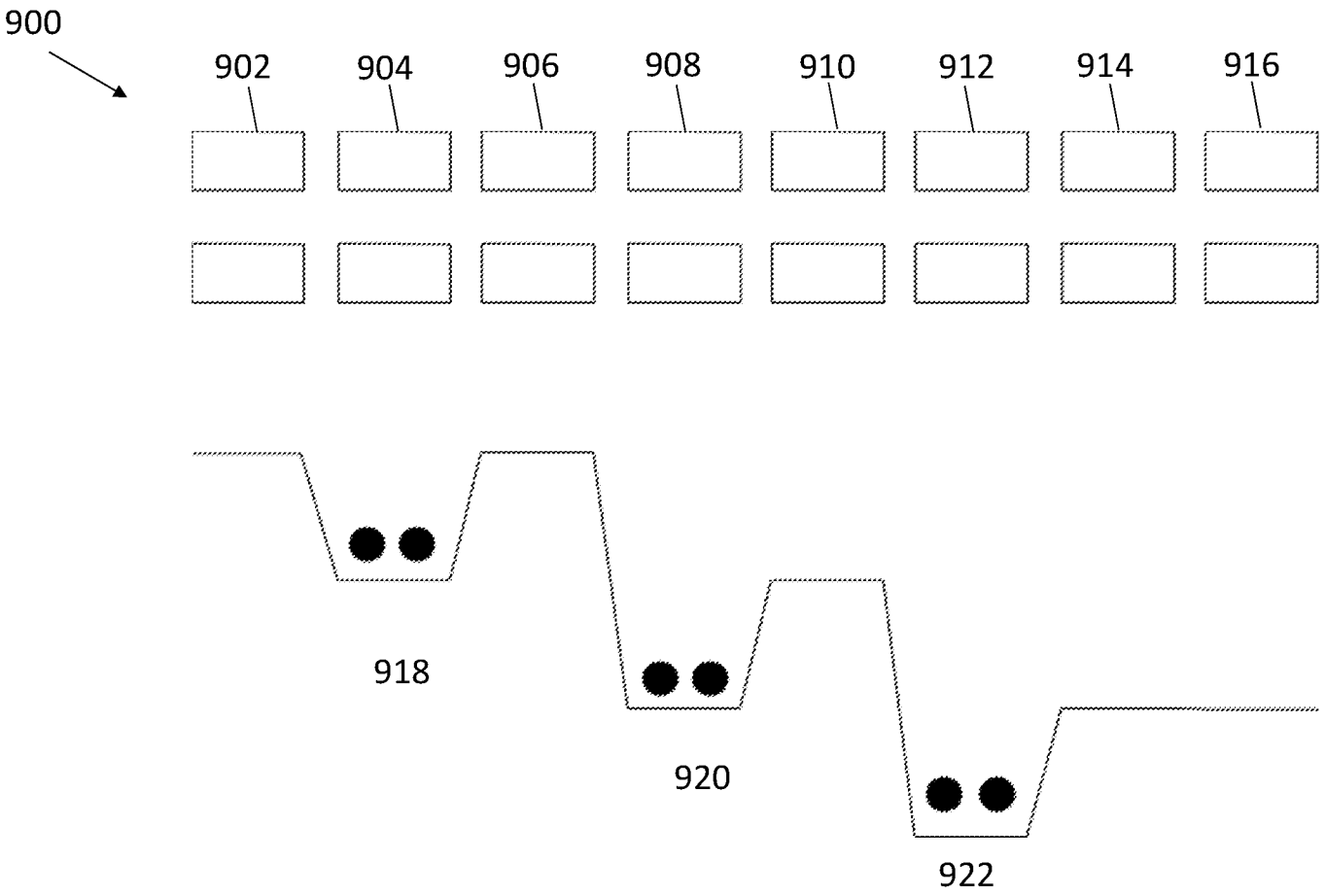
FIG. 10 is a schematic view of an ion-electron interaction module according to an embodiment in which the application of DC voltages to selected quadrupole rod sets generates three DC potential wells at different potentials.

By way of further illustration, FIG. 10 schematically depicts another embodiment of an electron-ion interaction module 900 according to the present teachings, which includes quadrupole rod sets 902, 904, 906, 908, 910, 912, 914, and 916 that are positioned in series about a common longitudinal axis. The application of DC voltages, for example, in a range of about 0 V to about 100 V, to selected quadrupole rod sets (e.g., as shown in the figure) can result in the generation of three potential wells 918, 920, and 922 at quadrupole rod sets 904, 908 and 912. In this embodiment, the DC potential well 918 in quadrupole rod set 904 is shallower than the DC potential well 920 in quadrupole rod set 908 and the DC potential well 920 is shallower than the DC potential well 922 in quadrupole rod set 912. The potential wells can modulate the kinetic energy of the electrons passing through the electron-ion interaction module with the electron kinetic energy increasing from the potential well 912 to the potential well 904. In this embodiment, the same precursor ions can be trapped in the potential wells and exposed to electrons having different kinetic energies.

Figure 11A:
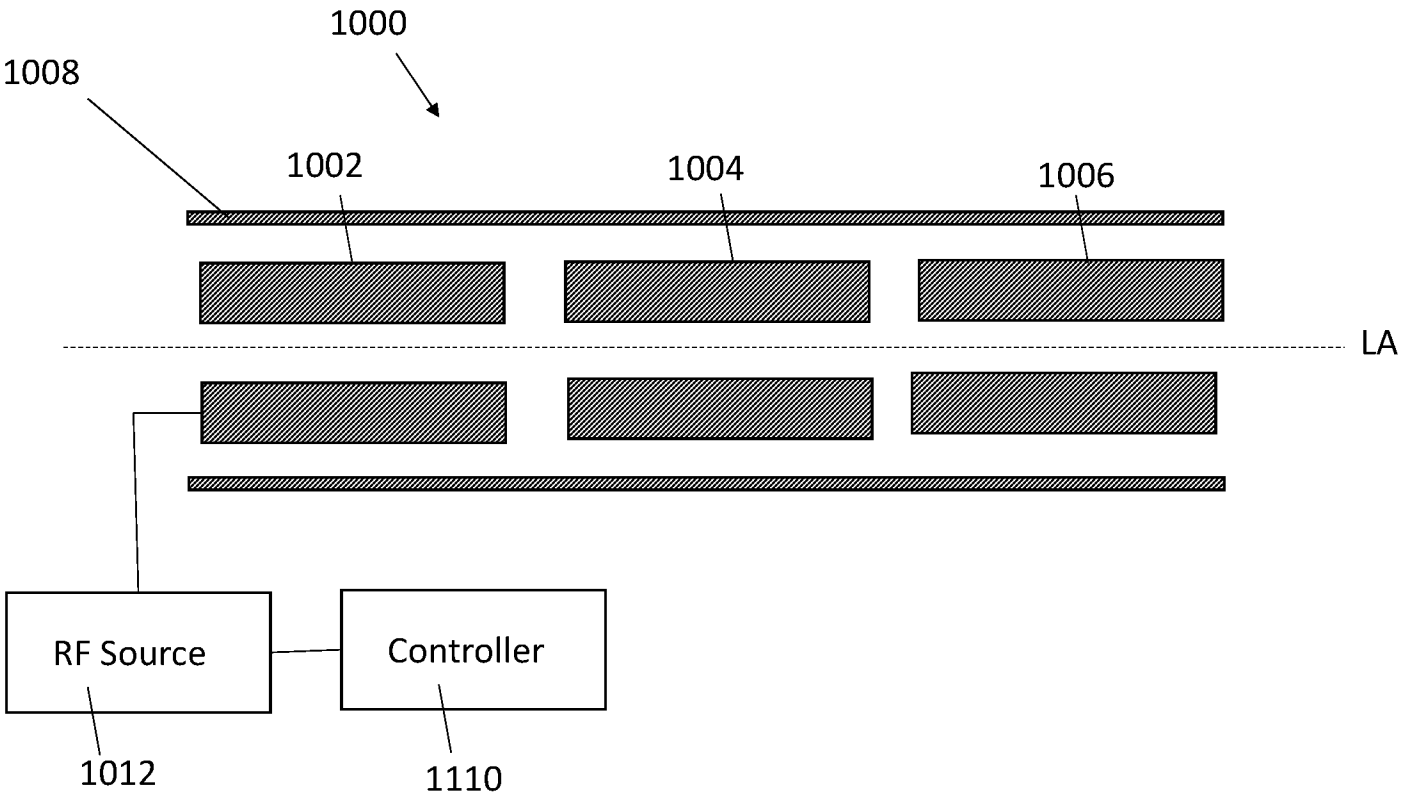
FIG. 11A is a schematic view of an ion-electron interaction module according to an embodiment, which employs a plurality of hexapole rod sets.
Figure 11B:
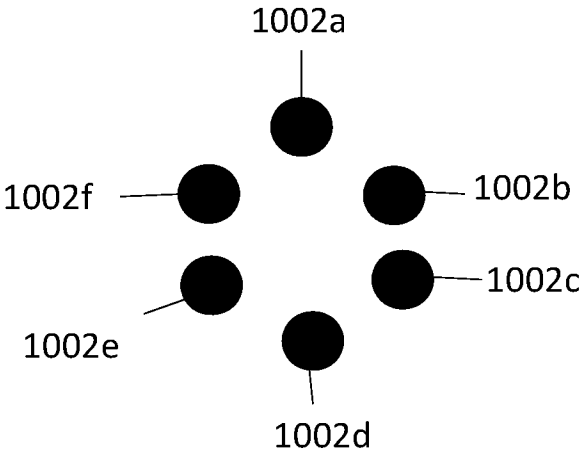
FIG. 11B is a schematic end view of one of the hexapole rod sets employed in the ion-electron interaction module depicted in FIG. 11A, FIG. 12 schematically depicts another embodiment of an electron-ion interaction module according to the present teachings, which employs a plurality of ring electrodes in a stacked ring configuration, FIG. 13 schematically depicts a mass spectrometer in which an ion-electron interaction module according to the present teachings is incorporated, FIG. 14 schematically depicts another mass spectrometer in which an ion-electron interaction module according to the present teachings is incorporated, FIGS. 15A and 15B schematically depict the ion interface module employed in the mass spectrometer depicted in FIG. 14.

Although the above embodiments of an electron-ion interaction module employ quadrupole rod sets, in other embodiments, an electron-ion interaction module according to the present teachings can be implemented using other multi-pole rods sets. For example, FIGS. 11A and 11B schematically depict an electron-ion interaction module 1000 according to another embodiment, which includes three hexapole rods sets 1002, 1004, 1006 that are positioned in tandem. Each hexapole rod set includes six rods that are arranged around a common longitudinal axis (LA). For example, FIG. 11B shows that the hexapole rod set 1002 includes rods 1002*a*, 1002*b*, 1002*c*, 1002*d*, 1002*e*, and 1002*f* that are arranged around the common longitudinal axis (LA). Similar to the previous embodiments, a magnet 1008 can surround the hexapole rod sets to apply a static magnetic field substantially along the longitudinal axis (LA). In other embodiments, other multi-pole rod sets can be employed in an electron-ion interaction module according to the present teachings.

A controller 1110 in communication with an RF source 1012 controls the application of RF voltages generated by the RF source to the rods of the hexapole rod sets such that an RF voltage applied to a rod of any of the hexapole rod sets has an opposite phase relative to an RF voltage applied to a respective rod of an adjacent hexapole rod set. Other embodiments can employ other rod sets, for example, octupole rod sets.

Figure 12:
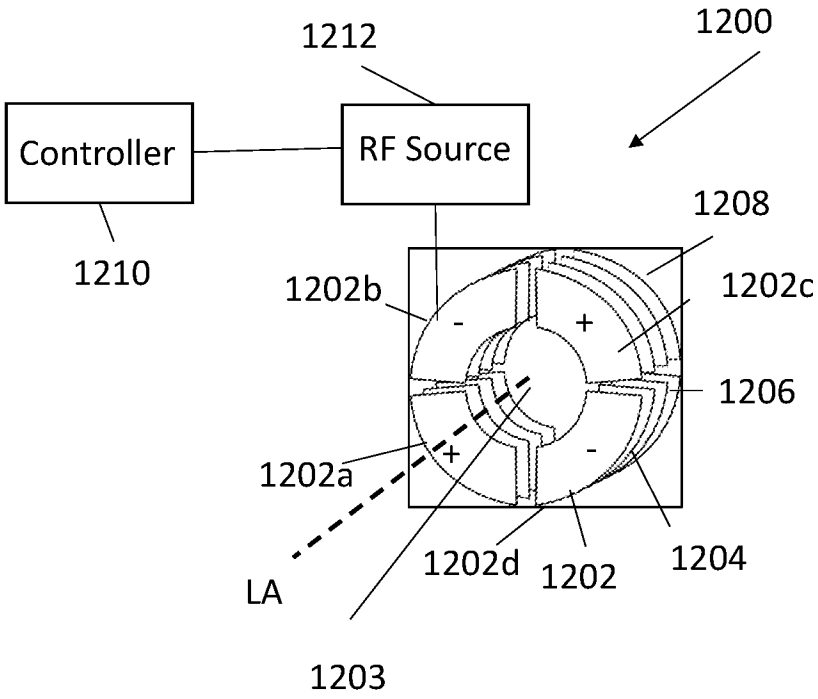

By way of further illustration of the wide applicability of the present teachings, FIG. 12 schematically depicts another embodiment of an electron-ion interaction module 1200 according to the present teachings, which employs a plurality of ring electrodes in a stacked ring configuration. In particular, in this embodiment, the electron-ion interaction module includes four quadrupole ring electrode sets 1202, 1204, 1206 and 1208 that are placed in tandem about a common longitudinal axis (LA) so as to define an electron-ion interaction volume. The set 1202 includes four ring electrodes 1202*a*, 1202*b*, 1202*c* and 1202*d*, each of which is in the shape of an arc of a circle, that are positioned relative to one another to provide a circular opening 1203 through which electrons and ions can enter the electron-ion interaction module. Each of the other electrode sets is formed similarly and provides a circular opening through which electrons and ions can pass.

With continued reference to FIG. 12, a controller 1210 in communication with an RF source 1212 controls the application of the RF voltages to the electrodes of the quadrupole electrode sets such that an RF voltage applied to an electrode of any of the quadrupole electrode sets has an opposite phase relative to an RF voltage applied to a respective electrode of an adjacent quadrupole electrode set. Similar RF frequencies and voltages as those discussed above in connection with the previous embodiments can be used in this embodiment. In this manner, the electrons injected into the electron-ion interaction region can be confined in the vicinity of the longitudinal axis as the electrons travel along the length of the quadrupole rod sets.

Figure 13:
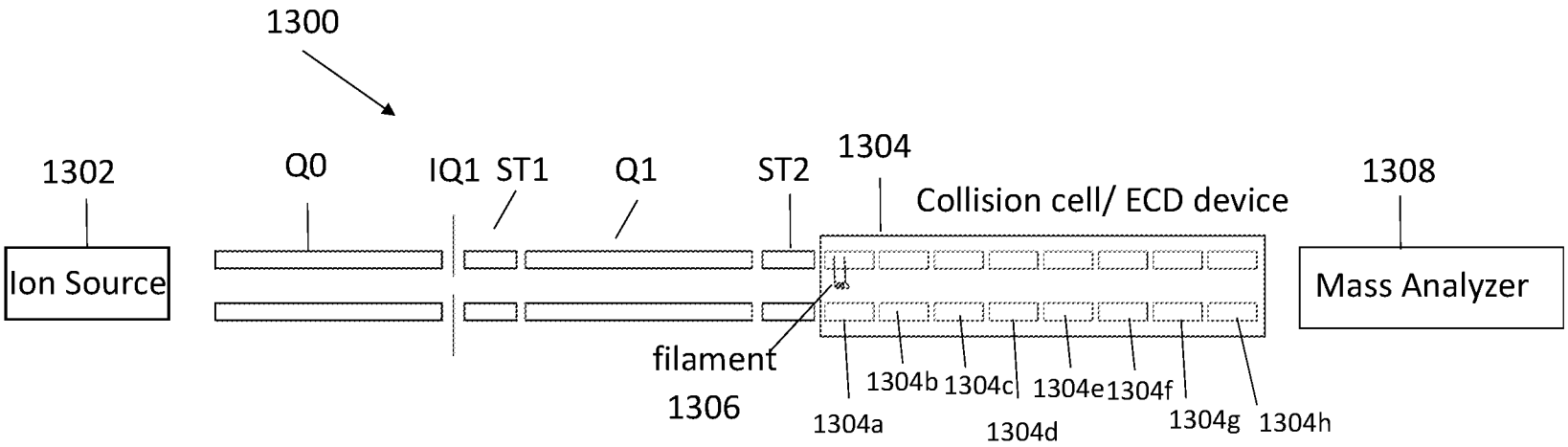

An electron-ion interaction module according to the present teachings can be incorporated in a variety of different mass spectrometers. By way of example, FIG. 13 schematically depicts a mass spectrometer 1300 that includes an ion source 1302 for generating ions. The ion source can be separated from the downstream section of the spectrometer by a curtain chamber (not shown) in which an orifice plate (not shown) is disposed, which provides an orifice through which the ions generated by the ion source can enter the downstream section. In this embodiment, an RF ion guide (Q0) can be used to capture and focus the ions using a combination of gas dynamics and radio frequency fields. The ion guide Q0 delivers the ions via a lens IQ1 and stubby ST1 to a downstream quadrupole mass analyzer Q1, which can be situated in a vacuum chamber that can be evacuated to a pressure that can be maintained lower than that of the chamber in which RF ion guide Q0 is disposed. By way of non-limiting example, the vacuum chamber containing Q1 can be maintained at a pressure less than about $1\times10^{-4}$ Torr (e.g., about $5\times10^{-5}$ Torr), though other pressures can be used for this or for other purposes.

As will be appreciated by a person of skill in the art, the quadrupole rod set Q1 can be operated as a conventional transmission RF/DC quadrupole mass filter that can be operated to select an ion of interest and/or a range of ions of interest. By way of example, the quadrupole rod set Q1 can be provided with RF/DC voltages suitable for operation in a mass-resolving mode. As should be appreciated, taking the physical and electrical properties of Q1 into account, parameters for an applied RF and DC voltage can be selected so that Q1 establishes a transmission window of chosen m/z ratios, such that these ions can traverse Q1 largely unperturbed. Ions having m/z ratios falling outside the window, however, do not attain stable trajectories within the quadrupole and can be prevented from traversing the quadrupole rod set Q1. It should be appreciated that this mode of operation is but one possible mode of operation for Q1. By way of example, in some embodiments, the quadrupole rod set Q1 can be configured as an ion trap. In some aspects, the ions can be Mass-Selective-Axially Ejected from the Q1 ion trap in a manner described by Hager in "*A new Linear ion trap mass spectrometer*," Rapid Commun. Mass Spectro. 2002; 16: 512-526.

Ions passing through the quadrupole rod set Q1 can pass through the stubby ST2 to enter an electron-capture dissociation cell 1304 according to the present teachings. The electron-capture dissociation cell 1304 includes eight quadrupole rod sets 1304*a*, 1304*b*, 1304*c*, 1304*d*, 1304*e*, 1304*f*, 1304*g*, and 1304*h* that are positioned in tandem along a common longitudinal axis. A filament 1306 disposed at the proximal end of the quadrupole rod set 1304*a* functions as a source of electrons when heated. Similar to the embodiments of electron-ion interaction modules discussed above, a controller (not shown in this figure) in communication with an RF source (also not shown in this figure) controls the application of the RF voltages to the rods of the quadrupole rod sets such that an RF voltage applied to a rod of any of the quadrupole rod sets has an opposite phase relative to an RF voltage applied to a respective rod of an adjacent quadrupole rod set. As discussed above, in this manner, the electrons can remain confined in the vicinity of the longitudinal axis of the quadrupole rod sets and interact efficiently with the precursor ions entering the electron-capture dissociation module. The capture of one or more electrons by the precursor ions can result in fragmentation of at least a portion of the precursor ions. The fragmented ions can be detected and analyzed by a downstream mass analyzer 1308 in a manner known in the art.

Figure 14:
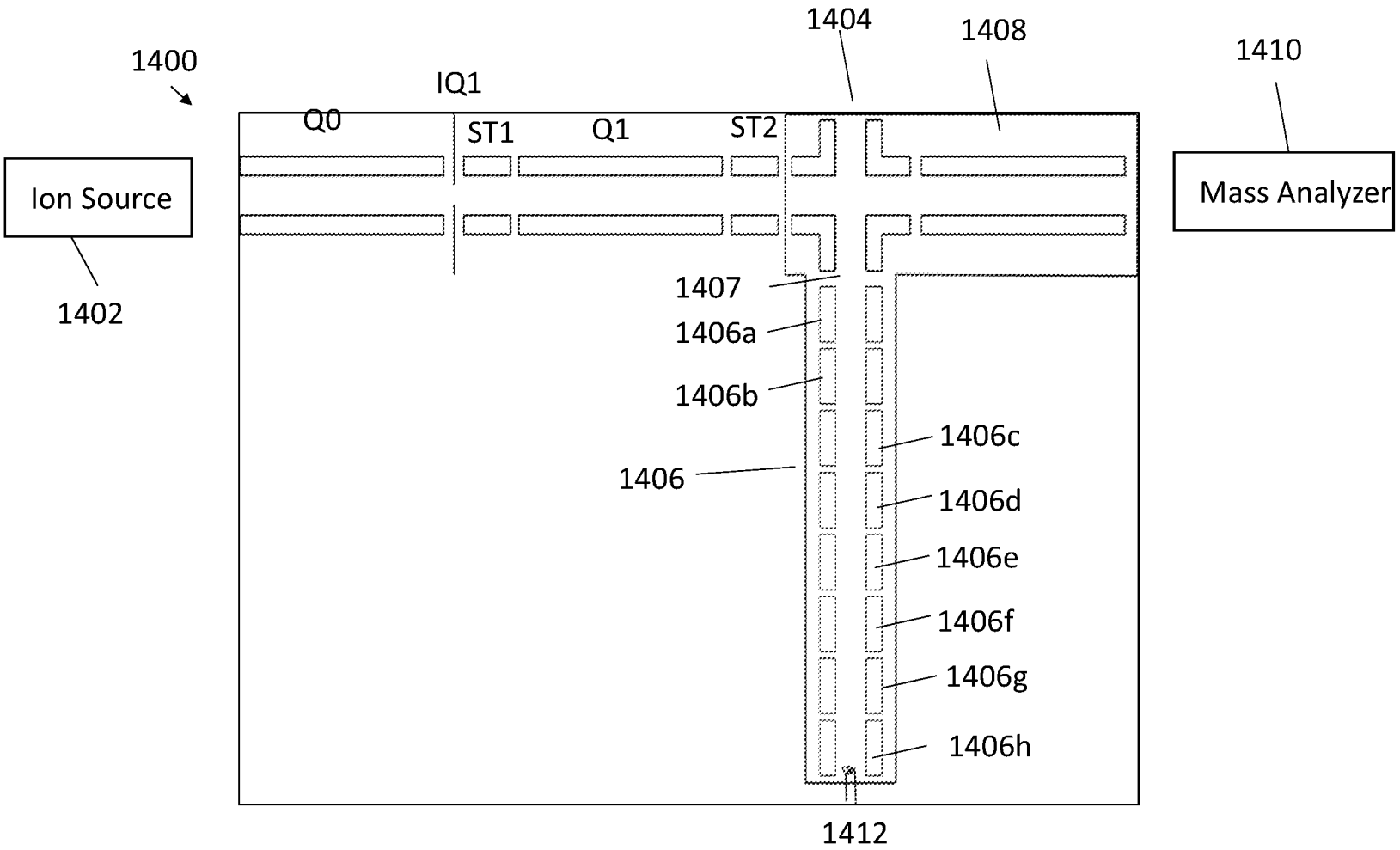

FIG. 14 schematically depicts another embodiment of a mass spectrometer 1400 in which an electron-ion interaction module according to the present teachings is incorporated. Similar to the previous embodiment, the mass spectrometer 1400 includes an ion source 1402 for generating ions, an RF ion guide Q0, a lens IQ1, a stubby ST1, an RF/DC quadrupole mass filter Q1, and a stubby ST2, which function in a manner similar to that described above in the connection with the previous embodiment.

With continued reference to FIG. 14, the mass spectrometer 1400 further includes an interface device 1404, herein referred to also as "chimera device," which can be configured in one operating mode (herein referred as the "injection mode") to inject the ions passing through the stubby ST2 into an electron-ion interaction module 1406 according to the present teachings to allow the ions to interact with electrons within the interaction module. In another operating mode (herein referred to as the "extraction mode"), the chimera device can be configured to extract at least a portion of the ions that have captured electrons within the electron-ion interaction module and ion-electron reaction products and direct those ions to a collision cell 1408. While in many embodiments, fragmentation can preferentially occur in the electron-ion interaction module, some fragmentation may also occur in the collision cell. A mass analyzer 1410 disposed downstream of the collision cell 1408 can detect and analyze the fragment ions to generate a mass spectrum.

In this embodiment, the electron-ion interaction module 1406 includes eight quadrupole rod sets 1406*a*, 1406*b*, 1406*c*, 1406*d*, 1406*e*, 1406*f*, 1406*g*, and 1406*h*, which are positioned in tandem about a common longitudinal axis, which can receive the ions from the chimera device via a proximal opening 1407. Similar to the previous embodiments, a magnet (not shown in this figure) can surround the quadrupole rod sets to apply a static magnetic field substantially along the longitudinal axis of the rod sets. A filament 1412 disposed at the distal end of the module can generate electrons for interacting with the ions injected into the electron-ion interaction module 1406 via the chimera device. In this embodiment, the electron-ion interaction module operates as an electron capture device. Similar to the previous embodiment, a controller in communication with an RF source (not shown in this figure) controls the application of the RF voltages to the electrodes of the quadrupole electrode sets such that an RF voltage applied to a rod of any of the quadrupole rod sets has an opposite phase relative to an RF voltage applied to a respective rod of an adjacent quadrupole rod set. Similar RF frequencies and voltages as those discussed above in connection with the previous embodiments can be used in this embodiment.

In this manner, the electrons injected into the electron-ion interaction module can be confined in the vicinity of the longitudinal axis of the electron-ion interaction module as the electrons travel along the length of the quadrupole rod sets.

Figure 15A:
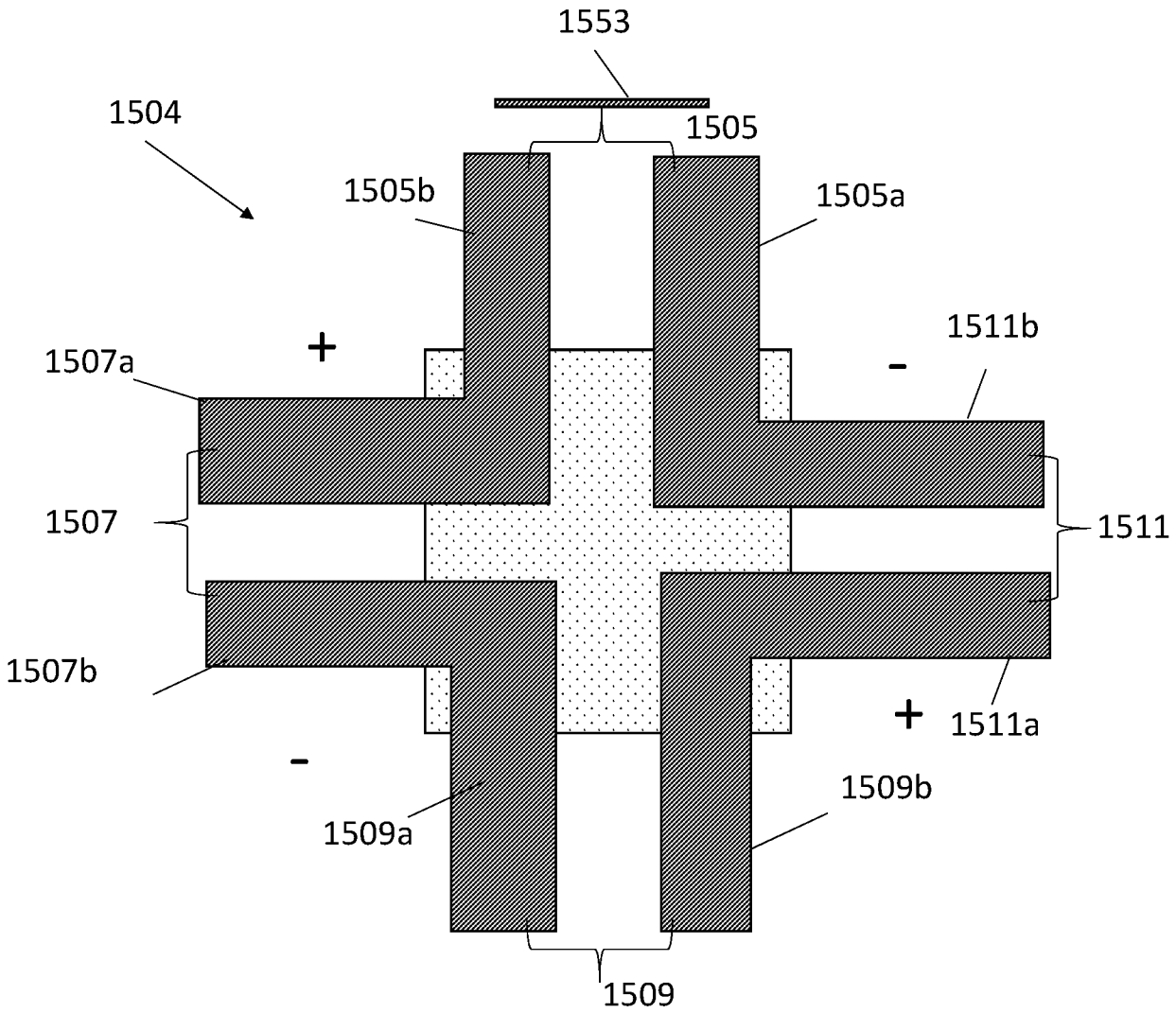
Figure 15B:
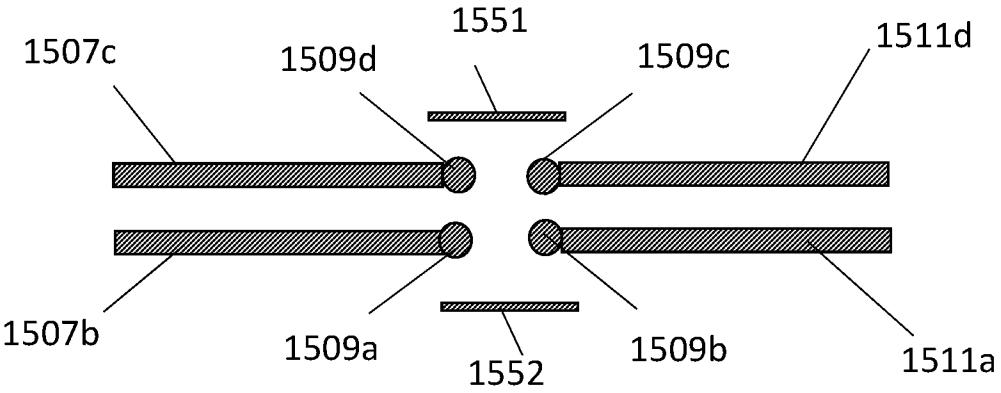

With reference to FIGS. 15A and 15B, in this embodiment, the chimera interface device 1504 includes four rod sets 1505, 1507, 1509, and 1511, where each rod set has a generally square-shaped quadrupolar configuration. Specifically, the rod set 1505 includes four rods 1505*a*, 1505*b*, and two rods not shown arranged in a quadrupole configuration, the rod set 1507 includes four rods 1507*a*, 1507*b*, 1507*c*, and one rod not shown arranged in a quadrupole configuration, the rod set 1509 includes four rods 1509*a*, 1509*b*, 1509*c* and 1509*d* arranged in a quadrupole configuration, and the rod set 1511 includes four rods 1511*a*, 1511*b*, 1511*d*, and one rod not shown arranged in a quadrupole configuration. A pair of blocking electrodes 1551 and 1552 can be added to the interface device to prevent analyte ions from escaping the interface device in the region where the rods sets meet one another. Further, as in this embodiment the ion source is not connected to the entrance of the rod set 1505, an additional electrode or blocking plate 1553 can be placed in close proximity to the entrance of the rod set 1505 and an appropriate voltage can be applied to the blocking plate/electrode to prevent ions from escaping the interface device via the entrance of the rod set 1505.

The ions entering the interface device can be radially confined within the device via the application of RF potentials to the rod sets of the interface device in a manner known in the art. The magnitude and frequency of the applied RF potentials can be chosen depending, for example, on the nature of the analyte ions. For example, the "+" and "−" signs in the FIG. 15A indicate that a rod is connected to a particular terminal of the RF power supply (not shown). Furthermore, at the exit of a given rod set, there is a voltage drop of a few volts or tens of volts that can define the direction in which the ions travel. When operating in the injection mode, the application of voltage drops can cause positive ions entering the interface device to be diverted into the ion-electron interaction module 1406 and when operating in the extraction mode, the voltage drops are configured so as to extract positively charged ions generated within the ion-electron interaction module via electron capture by the ions injected into the module and direct the extracted ions to the collision cell 1408.

Figure 16A:
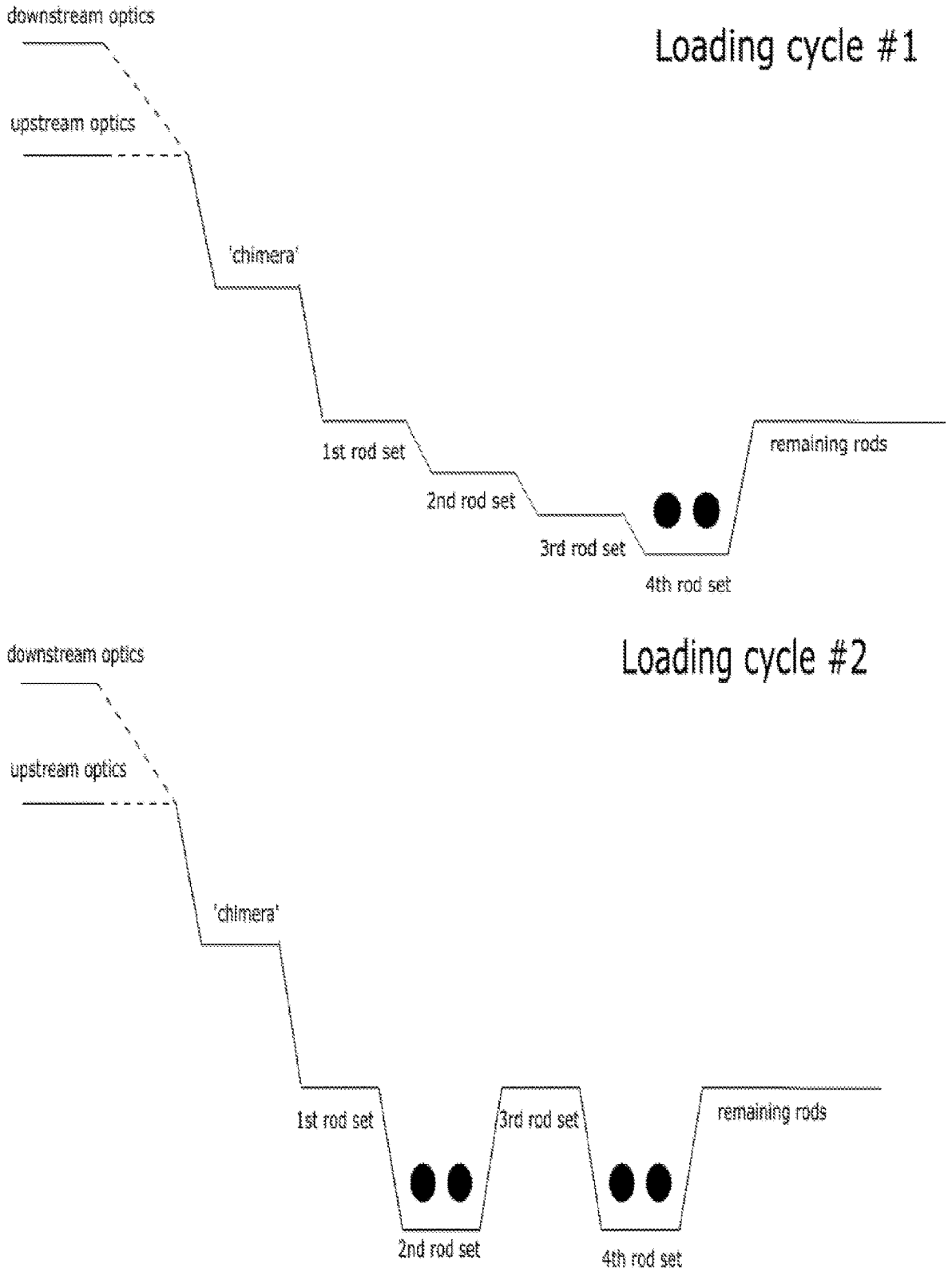
FIG. 16A depicts examples of rod potentials for the device of FIG. 14 for two consecutive ion loading cycles.
Figure 16B:
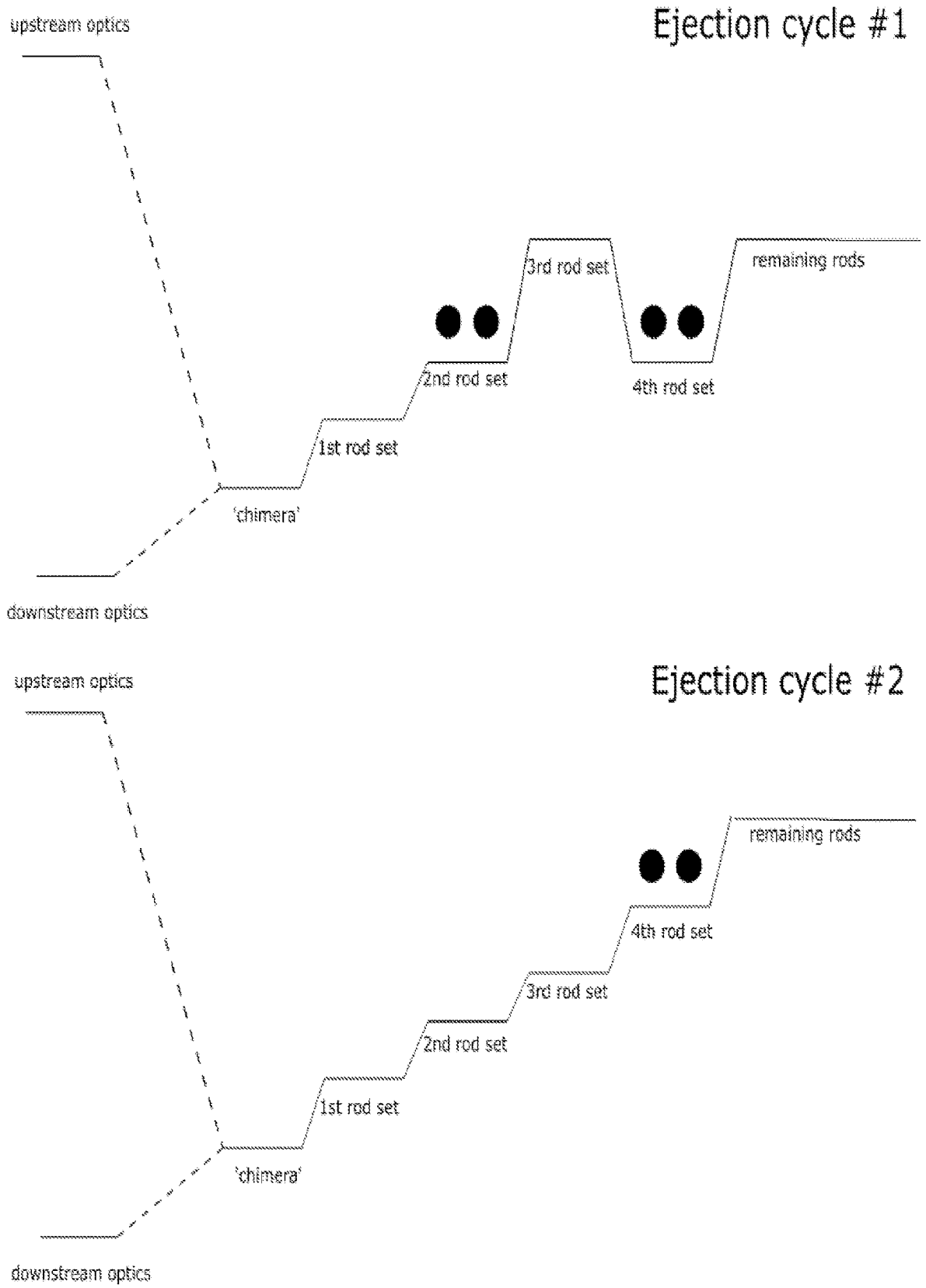
FIG. 16B depicts examples of rod potentials for the device of FIG. 14 for two consecutive ion ejection cycles.

By way of example, FIG. 16A depicts examples of rod potentials for two consecutive ion loading cycles, and FIG. 16B depicts example of rod potentials for two consecutive ejection cycles. Further details regarding an exemplary implementation of the interface device 1404 can be found, e.g., in U.S. Published Application No. 2007/0057178, which is herein incorporated by reference in its entirety.

Referring again to FIG. 14, the ions can undergo fragmentation in the electron-ion reaction module as well as the collision cell 1408 and the fragment ions can be detected and analyzed by a downstream mass analyzer 1410.

Those having ordinary skill in the art will appreciate that various changes can be made to the above embodiments without departing from the scope of the invention.

What is claimed is:

1. An electron-ion interaction module for use in a mass spectrometer, comprising:

a plurality of rod sets arranged relative to one another such that said rod sets share a common longitudinal axis and each of said rod sets is longitudinally separated from an adjacent rod set by a gap, each of said rod sets comprising a plurality of rods arranged around said common longitudinal axis, at least one magnet disposed around said rod sets so as to at least partially surround one or more of said plurality of rod sets and configured to generate a static magnetic field along said longitudinal axis, said rod sets being configured to receive electrons from an electron source and ions from an ion source within an interaction volume defined by the rods of said rod sets, one or more RF voltage sources operatively coupled to said plurality of rod sets for applying voltages to the rods of said rod sets such that an RF voltage applied to a rod of any of said rod sets has an opposite phase relative to an RF voltage applied to a respective rod of an adjacent rod set;

and wherein said rods sets are configured to receive said ions and electrons substantially along said common longitudinal axis.

2. The electron-ion interaction module of claim 1, wherein each of said rod sets comprises any of a quadrupole, a hexapole and an octupole rod set.

3. The electron-ion interaction module of claim 1, wherein said plurality of rod sets comprises at least three rod sets.

4. The electron-ion interaction module of claim 1, wherein said applied voltages are configured to cause radial trapping of said ions within said interaction volume.

5. The electron-ion interaction module of claim 1, wherein said magnetic field has a strength in a range of about 0.1 Tesla to about 21 Tesla.

6. The electron-ion interaction module of claim 1, wherein said one or more RF voltage sources are configured to generate RF voltages at a frequency in a range of about 200 kHz to about 100 MHz.

7. The electron-ion interaction module of claim 1, wherein said RF voltages have an amplitude in a range of about 100 V to about 10 kV.

8. The electron-ion interaction module of claim 1, wherein said gap separating adjacent quadrupole rod sets is in a range of about 0.1 mm to about 10 mm.

9. The electron-ion interaction module of claim 1, further comprising a plurality of ion-trapping rods disposed between two or more rods of at least one of said rod sets, and a DC voltage source for applying one or more DC voltages to said ion-trapping rods for trapping at least a portion of said ions within a volume of said at least one of said rod sets.

10. The electron-ion interaction module of claim 9, further comprising an electrode disposed in proximity of an exit port of said plurality of rod sets and configured for providing axial trapping of the ions upon application of a suitable voltage thereto.

11. The electron-ion interaction module of claim 1, further comprising a controller in communication with said at least one RF voltage source for controlling application of RF voltages to the rods of said rod sets.

12. The electron-ion interaction module of claim 1, wherein said electron-ion interaction module comprises any of an electron capture interaction module, electron impact dissociation (EID) module, electron impact excitation of ions from organics (EIEIO) module, and electron detachment dissociation (EDD) module.

13. A mass spectrometer comprising:

a linear ion trap (LIT) comprising at least three rod sets arranged relative to one another such that said rod sets share a common longitudinal axis and each of said rod sets is longitudinally separated from an adjacent rod set by a gap, each of said rod sets comprising a plurality of rods arranged in a quadrupole configuration around said common longitudinal axis, said linear ion trap comprising an inlet for receiving ions and electrons substantially along said longitudinal axis, an electron source that generates electrons and introduces said electrons into said linear ion trap substantially along said longitudinal axis, an ion source that for generates ions and introduces said ions into said linear ion trap substantially along said longitudinal axis, at least one magnet disposed around said rod sets so as to at least partially surround one or more of said plurality of rod sets and configured to generate a magnetic field along said longitudinal axis, one or more RF voltage sources operatively coupled to said plurality of rod sets for applying voltages to the rods of said rod sets such that an RF voltage applied to a rod of any of said rod sets has an opposite phase relative to an RF voltage applied to a respective rod of an adjacent rod set, wherein said applied RF voltages are configured to generate an RF electromagnetic field for radially confining said ions within said linear ion trap.

14. The mass spectrometer of claim 13, wherein each of said rod sets comprises any of a quadrupole, a hexapole and an octupole rod set.

15. The mass spectrometer of claim 13, wherein said longitudinal magnetic field has a strength in a range of about 0.1 Tesla to about 21 Tesla.

16. The mass spectrometer of claim 13, wherein said RF voltage sources are configured to generate RF voltages at a frequency in a range of about 200 kHz to about 10 MHz.

17. The mass spectrometer of claim 13, wherein said RF voltages have an amplitude in a range of about 100 V to about 10 kV.

18. The mass spectrometer of claim 13, wherein said gap separating adjacent quadrupole rod sets is in a range of about 0.1 mm to about 10 mm.

19. A method of performing electron-ion interaction, comprising:

introducing ions and electrons into a plurality of rod sets arranged relative to one another such that said rod sets share a common longitudinal axis and each of said rod sets is longitudinally separated from an adjacent rod set by a gap, each of said rod sets comprising a plurality of rods arranged about said common longitudinal axis, and wherein said rods sets are configured to receive said ions and electrons substantially along said common longitudinal axis;

applying a static magnetic field along said common longitudinal axis, applying RF voltages to said plurality of rod sets so as to confine said ions and electrons within a volume surrounded by the rods of said plurality of quadrupole rod sets, wherein an RF voltage applied to a rod of any of said quadrupole rod sets has an opposite phase relative a an RF voltage applied to a respective rod of an adjacent quadrupole rod set.

* * * * *